US008783897B2

(12) United States Patent
Shih

(10) Patent No.: US 8,783,897 B2
(45) Date of Patent: Jul. 22, 2014

(54) LAMP MODULE WITH ELECTRONIC CONNECTOR ADAPTER

(75) Inventor: Cheng-Hung Shih, Taipei County (TW)

(73) Assignee: T1 Lighting Technology Co., Ltd., Sanchong (TW)

( * ) Notice: Subject to any disclaimer, the term of this patent is extended or adjusted under 35 U.S.C. 154(b) by 542 days.

(21) Appl. No.: 13/064,367

(22) Filed: Mar. 22, 2011

(65) Prior Publication Data

US 2012/0243218 A1 Sep. 27, 2012

(51) Int. Cl.

| | |
|---|---|
| ***F21V 23/02*** | (2006.01) |
| ***F21V 19/00*** | (2006.01) |
| ***F21V 15/01*** | (2006.01) |
| ***H01R 33/94*** | (2006.01) |

(52) U.S. Cl.

CPC ..... *H01R 33/942* (2013.01)
USPC ..... 362/222; 362/217.13; 362/217.17; 362/657; 362/260

(58) Field of Classification Search

USPC ..... 362/221, 222, 217.13, 217.17, 647, 362/652, 657, 658, 659, 260
See application file for complete search history.

(56) References Cited

U.S. PATENT DOCUMENTS

| | | | | |
|---|---|---|---|---|
| 2,356,601 | A * | 8/1944 | MacCarthy | 439/236 |
| 3,688,244 | A * | 8/1972 | Savoca et al. | 439/282 |
| 4,758,173 | A * | 7/1988 | Northrop | 439/232 |
| 4,799,134 | A * | 1/1989 | Pinch et al. | 362/320 |
| 4,994,710 | A * | 2/1991 | Roelevink et al. | 313/318.02 |
| 5,489,813 | A * | 2/1996 | Jung | 313/25 |
| 5,541,477 | A * | 7/1996 | Maya et al. | 313/493 |
| 5,634,820 | A * | 6/1997 | Vakil | 439/646 |
| 5,904,415 | A * | 5/1999 | Robertson et al. | 362/260 |
| 6,582,102 | B2 * | 6/2003 | Lin | 362/304 |
| 6,638,088 | B1 * | 10/2003 | Richardson | 439/242 |
| 7,129,625 | B2 * | 10/2006 | Marsh | 313/17 |
| 2005/0030750 | A1 * | 2/2005 | Ehmen et al. | 362/260 |

* cited by examiner

*Primary Examiner* — Ismael Negron
(74) *Attorney, Agent, or Firm* — C. G. Mersereau; Nikolai & Mersereau, P.A.

(57) ABSTRACT

A lamp module includes an external elongated housing made of at least one of a transparent and a translucent material; a lamp terminal with lamp pins at each end of the elongated housing, at least one cold cathode fluorescent lamp (CCFL) disposed in the external elongated housing a reflective layer disposed in the external lamp elongated housing, and an electronic connector adapter having a plurality of contact pins at one end and a plurality of connecting jacks at an opposite end for receiving the lamp pins of one of the lamp terminals.

8 Claims, 10 Drawing Sheets

LAMP MODULE WITH ELECTRONIC CONNECTOR ADAPTER

BACKGROUND OF THE INVENTION (1) Field of the Invention

The invention relates to a lamp cartridge adapter, and more particularly to an adapter module and a lamp module for cold cathode fluorescent lamp illumination.

(2) Description of the Prior Art

Conventionally, the cold cathode fluorescent lamp module is disposed the lamp cartridge adapter on the above the lamp, but the lamp have the following drawbacks.

First, when the adapter or any one of the CCFLs is damaged, the entire lamp has to be replaced, and the resource is wasted.

Second, for the technological level, the CCFLs and the adapter thereof are disposed in the lamp, the heat dissipating problem cannot be solved, and the thermal effect affects its lifetime.

Third, the lamp has no reflective layer for completely reflecting the visible light rays, diverging upwards, downwards, so that the downward illumination is affected. In addition, if the lamp has two CCFLs, the two CCFLs have the problem of parallelism, and tend to be broken when being transported.

Thus, it is an important subject of the invention to solve the problems of the conventional CCFL illumination device by providing a new solution to design the modularized adapter, disposed outside the lamp and serially connected to the lamp to form a new lamp. In addition, a reflective layer is disposed in the lamp to enhance the light emitting efficiency of the lamp and to solve the above-mentioned problem.

SUMMARY OF THE INVENTION

The technological problem to be solved by this invention is to provide a lamp cartridge adapter and a lamp module, wherein the adapter is modularized and externally connected to the lamp, and the cascaded total length and the lamp head structure are the same as those of the conventional fixture, so that the conventional lamp can be quickly replaced and the original lamp can be kept, the cost for replacing the lamp can be reduced and the light emitting efficiency of the lamp can be enhanced.

To solve the above-mentioned technological problem, the invention adopts the technological scheme to provide a lamp cartridge adapter, applied to a lamp module, comprising: an electronic adapter, having two terminals, one terminal formed with AC power input terminal, and another terminal electrically connected to a lamp pins of the lamp module; a housing, configuring to the electronic adapter, wherein the housing has a first end formed with a power connector, and an opposite second end formed with a lamp connector; a pair of contact pins, having first ends connected to the AC power input terminals of the electronic adapter, and second ends projecting beyond the power connector of the housing; and a pair of jacks penetrating through the lamp connector of the housing and being electrically connected to output terminal of the electronic adapter.

The invention further provides a lamp module, connected to amp cartridge adapter, the lamp module comprising: an external lamp, having at least one of a light-permeable material and a translucent material; two lamp heads, configuring to two terminal of the external lamp, and each lamp head has a plurality of lamp pin; at least one cold cathode fluorescent lamp (CCFL) disposed in the external lamp; and a reflective layer, dispose in the external lamp, the reflective layer having a reflective surface adjacent to and contactless to cold cathode fluorescent lamp.

The invention also further provides a lamp module, connected to amp cartridge adapter, the lamp module comprising: an external lamp, having at least one of a light-permeable material and a translucent material; two lamp heads, configuring to two terminal of the external lamp, and each lamp head has a plurality of lamp pin; at least one cold cathode fluorescent lamp (CCFL) disposed in the external lamp; and an lamp cartridge adapter, further compressing: an electronic adapter, having two terminal, one terminal formed with AC power input terminal, and another terminal electrically connected to a lamp pins of the lamp module; a housing, configuring to the electronic adapter, wherein the housing has a first end formed with a power connector, and an opposite second end formed with a lamp connector; a pair of contact pins, having first ends connected to the AC power input terminals of the electronic adapter, and second ends projecting beyond the power connector of the housing; and a pair of jacks penetrating through the lamp connector of the housing and being electrically connected to output terminal of the electronic adapter. Wherein a length of combining the lamp module with the lamp cartridge adapter satisfies a length specified in a daylight lamp standard.

The benefits that can be achieved by this invention are described in the following. When the CCFL or adapter is damaged, only the damaged lamp or adapter has to be replaced without all the elements being replaced. Thus, the maintenance cost of the lamp of this invention is far lower than that of the design, in which the adapter is disposed inside the lamp, so the resource can be saved, and the replacement can be conveniently and quickly performed. After the lamp and the adapter are modularized, the heat dissipating problem of the adapter can be easily solved because the adapter is disposed outside the lamp, and the poor influence caused by the thermal effect can be solved. In addition, the reflective layer is disposed in the lamp to enhance the light emitting efficiency of the lamp.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The preferred embodiment of the invention will be described with reference to the accompanying drawings.

Figure 1:
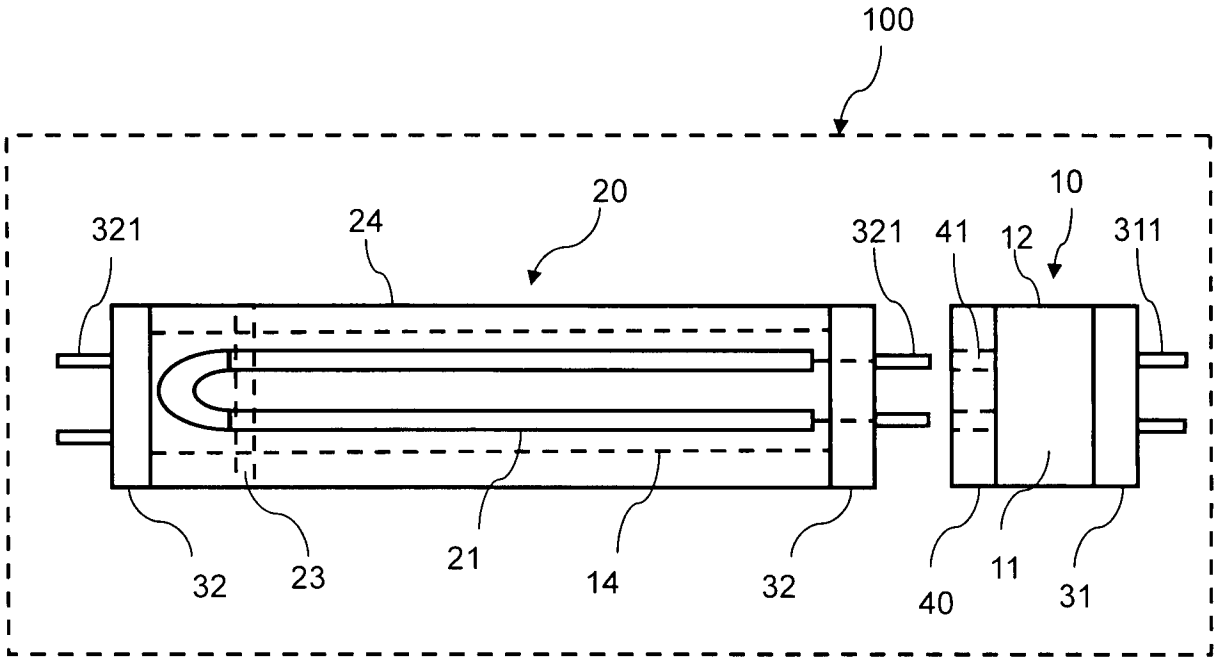
FIG. 1 is a schematic illustration showing a lamp cartridge adapter and a lamp module thereof according to an embodiment of the invention.

FIG. 1 is a schematic illustration showing a lamp cartridge adapter 10 and its lamp module according to the invention. The lamp cartridge adapter 10 is applied to a lamp module, the lamp cartridge adapter includes an electronic adapter 11 having two terminals, one terminal formed with AC power input terminals, and another terminal electrically connected to lamp pins 321 of a lamp module 20; a housing 12, configuring to the electronic adapter 11, wherein the housing 12 has a first end formed with a power connector 31 and an opposite second end formed with a lamp connector 40; a pair of contact pins 311 having first ends connected to the AC power input terminals of the electronic adapter 11, and second ends projecting beyond the power connector 31 of the housing 12; and a pair of jacks 41 penetrating through the lamp connector 40 of the housing 12 and being electrically connected to output terminals of the electronic adapter 11. The pair of jacks 41, made of an electro conductive metal material and has hollow structure, is to be elastically and electrically connected to the lamp pins 321 of the lamp module 20. The pair of jacks 41 and the lamp module 20 may constitute an illumination device.

Figure 5A:
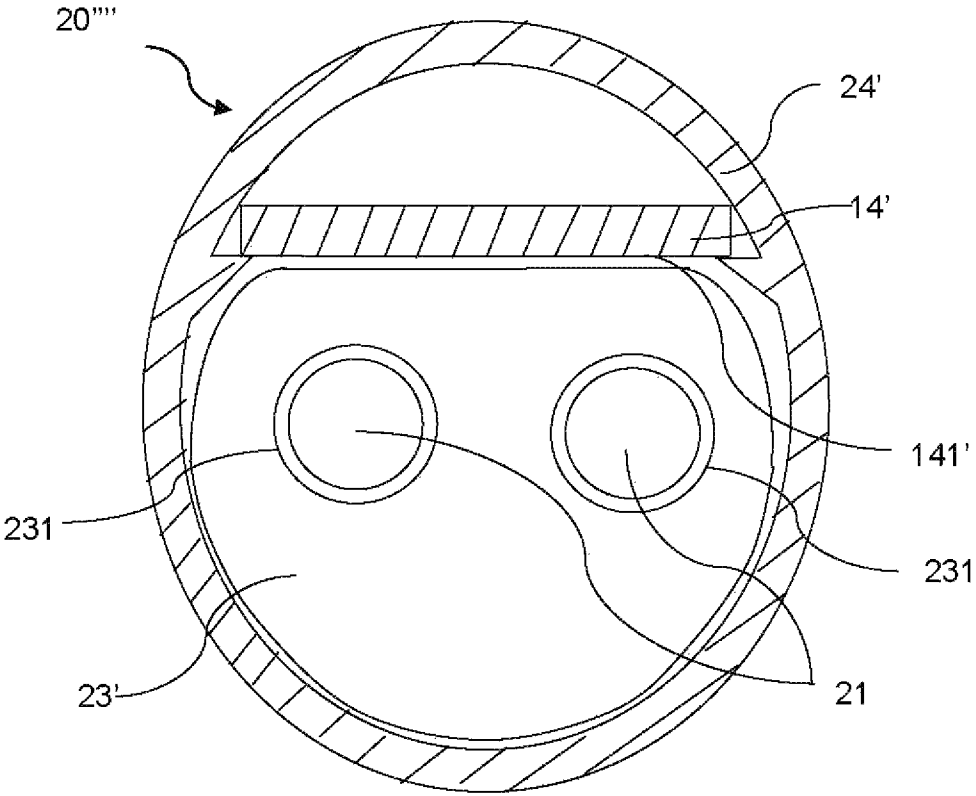
FIG. 5A is a schematic illustration showing a lamp module according to an embodiment of the invention.
Figure 5B:
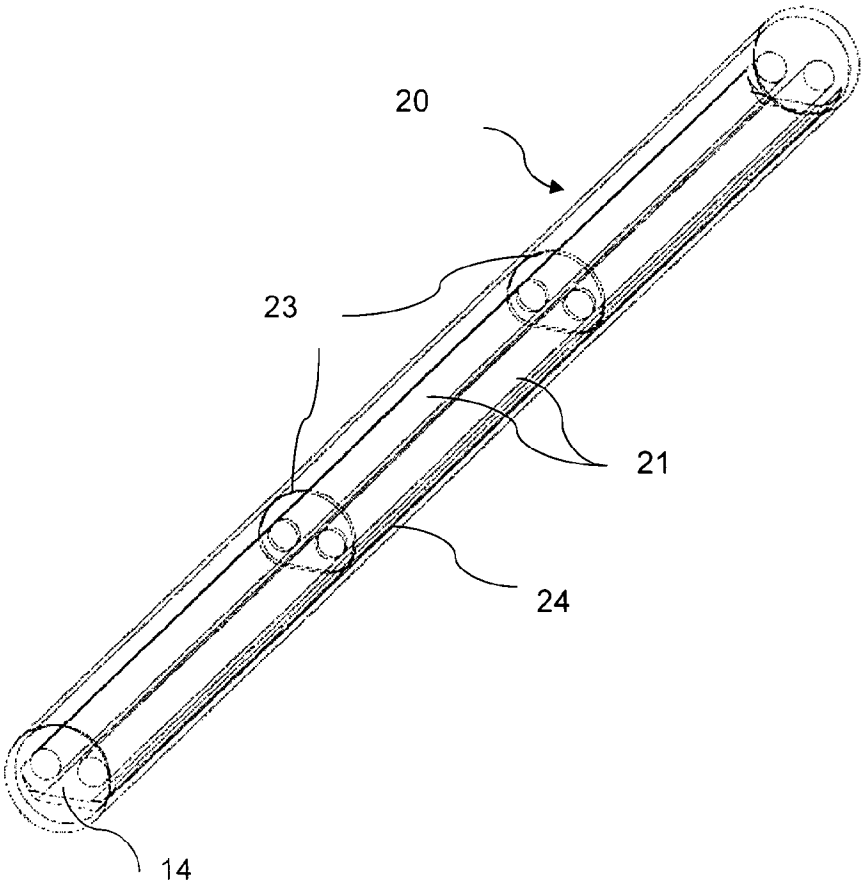
FIG. 5B is a pictorial view showing the lamp module according to the embodiment of the invention.
Figure 6A:
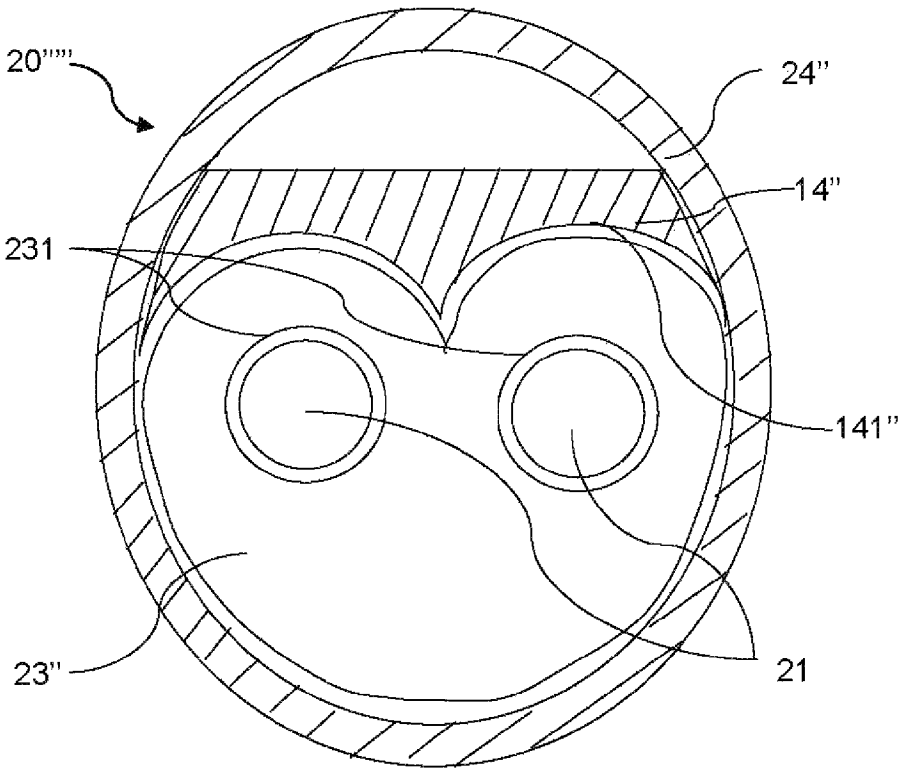
FIG. 6A is a schematic illustration showing a lamp module according to another embodiment of the invention.
Figure 6B:
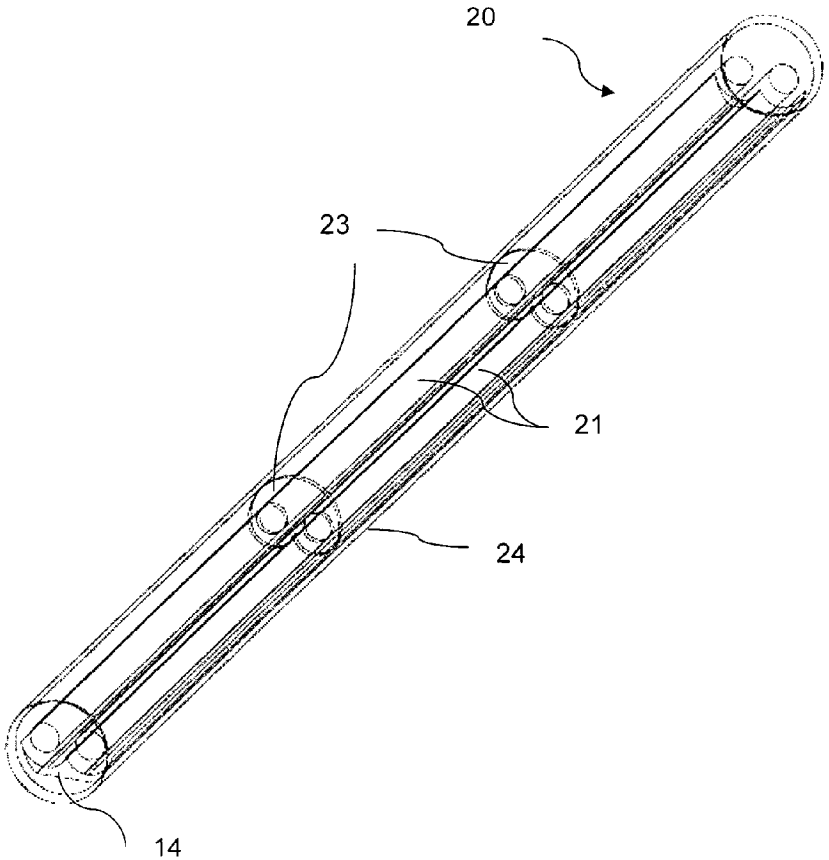
FIG. 6B is a pictorial view showing the lamp module according to another embodiment of the invention.

The lamp module 20 is connected to amp cartridge adapter, the lamp module, the lamp module 20 includes an external lamp 24, two lamps heads 32 and at least one CCFL 21. The lamp head 32 has a plurality of lamp pins 321. The CCFL 21 is disposed in the external lamp. The length of combining the lamp module 20 with the lamp cartridge adapter 10 satisfies a length specified in a daylight lamp standard, which is specified in the daylight lamp standard and is the same as the length of the conventional daylight lamp of T9, T8, T5 or the like. In order to solve the problem that the CCFL 21 tends to be broken when the lamp module 20 is being transported, the lamp module 20 further includes a plurality of support frame 23 having at least one support frame hole 231. The shape of the surface of the support frame 23 matches with the shape of a reflective surface 141 of a reflector 14 adjacent to the surface of the support frame 23. The number of the support frame hole(s) 231 and the aperture(s) of the support frame hole(s) 231 are determined according to the CCFL 21, and the size of the aperture of the support frame hole 231 is such that the CCFL 21 can penetrate therethrough. The support frame 23 also improves the problem of parallelism of two of CCFLs 21. In order to enhance the light emitting efficiency of the lamp module 20, the lamp module 20 further includes the reflector 14, dispose in the external lamp 24, has the reflective surface 141 (see FIGS. 5A and 6A), the reflective surface 141 is close to the CCFL 21 without contacting with the CCFL 21. The reflective surface 141 has the function of reflecting the light rays. The reflector 14 is integrally formed by way of press forming, extruding or injection molding, and the pictorial views after the reflector 14 is assembled are shown in FIGS. 5B and 6B. The external lamp 24 is made of a least one of light-permeable material and a translucent material and integrally formed by way of extruding. A sealant is added to the sealing portion between the external lamp 24 and the lamp head 32 to prevent the moisture from entering and increase the structural strength of the connection.

Figure 2:
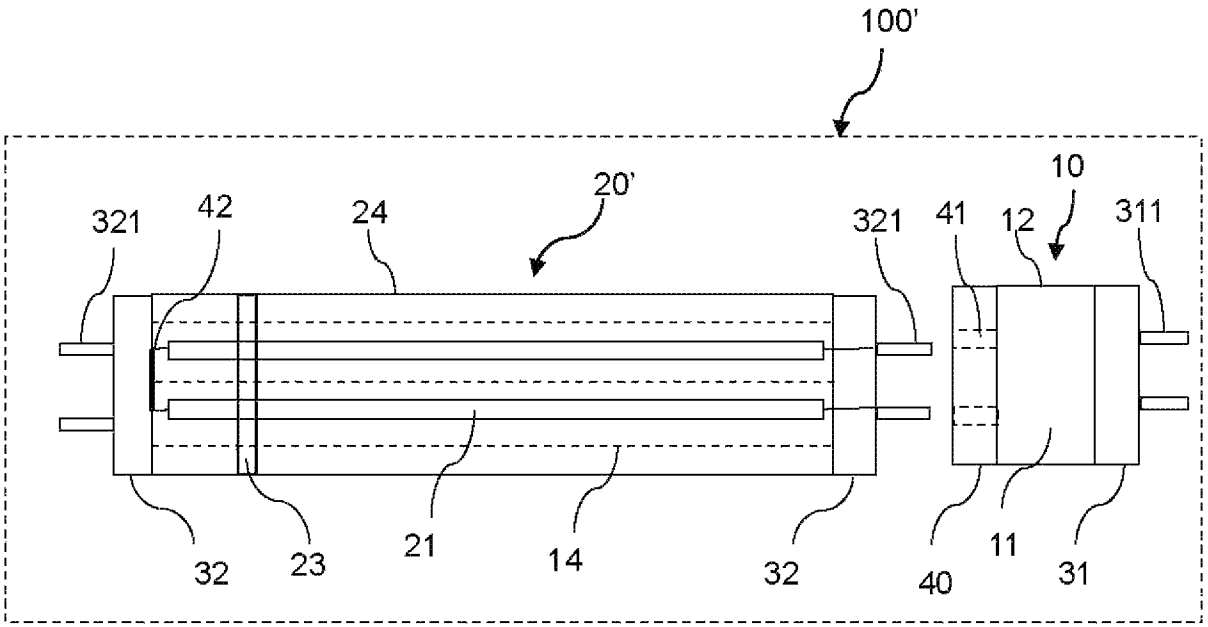
FIG. 2 is a schematic illustration showing a lamp cartridge adapter and a lamp module thereof according to another embodiment of the invention.

FIG. 2 is a schematic illustration showing a lamp cartridge adapter and a lamp module thereof according to another embodiment of the invention. As shown in FIG. 2, the CCFL 21 has two straight CCFLs, and a conductor 42 is provided to electrically connect the first end of the one straight CCFL to the second end of the other straight CCFL so that the U-shaped CCFL can be replaced with the two straight CCFLs. The technology is the same as the description of FIG. 1, and the CCFL 21 may also be modified to have any other shape. After the lamp module 20' of the invention is assembled with the cartridge adapter 10, the length of combining the lamp module with the lamp cartridge adapter is equal to the length of the daylight lamp of the conventional T9, T8, T5 or the like to satisfy the standard format of the illumination lamp and save a lot of molding costs.

Figure 3:
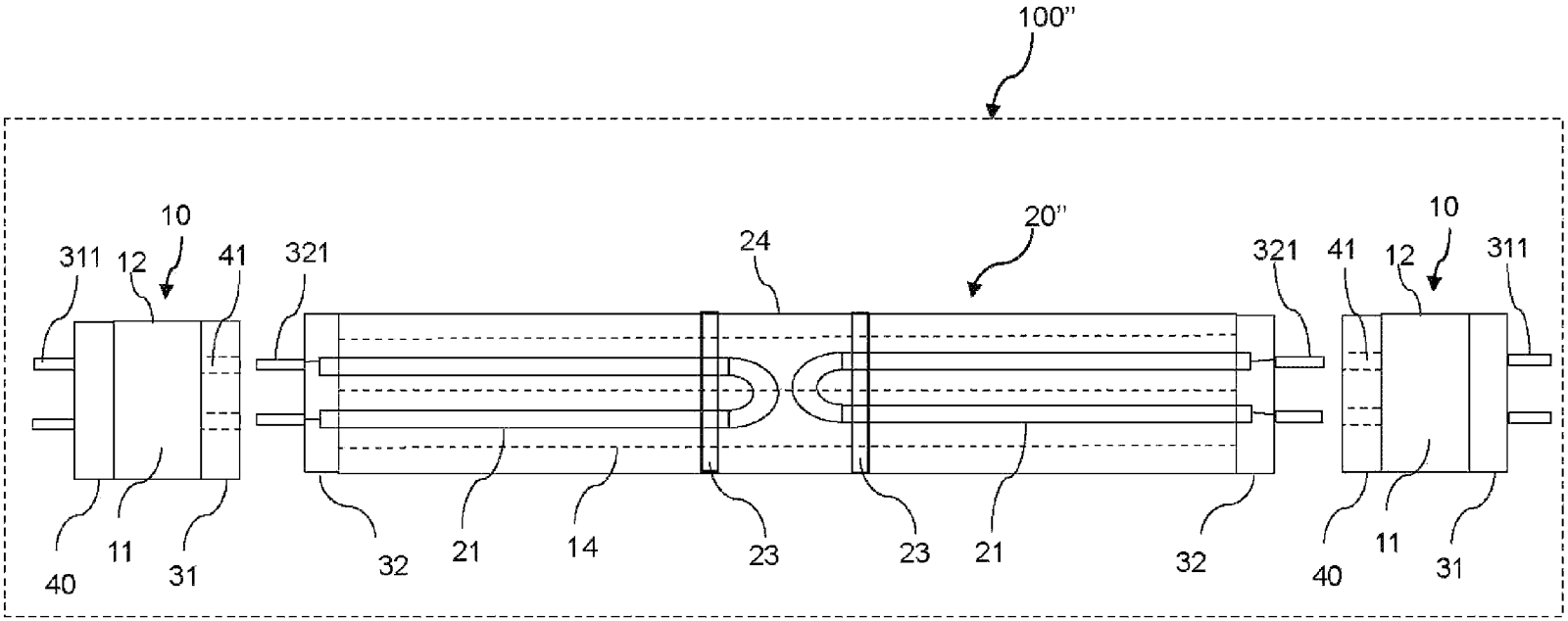
FIG. 3 is a schematic illustration showing a lamp cartridge adapter and a lamp module thereof according to still another embodiment of the invention.

FIG. 3 is a schematic illustration showing a lamp cartridge adapter and a lamp module thereof according to still another embodiment of the invention. Two lamp cartridge adapters 10 are respectively disposed on left and right ends of the lamp module 20". The technology of the lamp cartridge adapter 10 is the same as that of FIG. 1, and detailed descriptions thereof will be omitted.

The lamp module 20" is composed of one external lamp 24, a plurality lamp heads 32 and a plurality of U-shaped CCFLs 21. The lamp head has a plurality of lamp pins 321. The U-shaped CCFLs 21 are disposed in the external lamp. Each of two ends of the lamp module 20" is connected to one lamp cartridge adapter 10. The length of combining the lamp module 20" with the lamp cartridge adapter 10 satisfies the length, which is specified in the daylight lamp standard and is the same as the length of the conventional daylight lamp of T9, T8, T5 or the like. In order to solve the problem that the CCFL 21 tends to be broken when the lamp module 20" is being transported, the lamp module 20 further includes at least one support frame 23 having a hole 231 disposed in the external lamp 24. The shape of the surface of the support frame 23 matches with the shape of the reflective surface 141 of the reflector 14 adjacent to the surface of the support frame 23. The number of the hole(s) 231 and the size of the aperture of the support frame hole 231 are determined according to the CCFL(s) 21. The size of the aperture of the hole 231 is such that the CCFL 21 can just pass therethrough. The support frame 23 may also solve the problem of the parallelism of two CCFLs 21. In order to enhance the light emitting efficiency of the lamp module 20", the lamp module 20" further includes a reflector 14 disposed in the external lamp, which has a reflective surface 141 (as shown in FIGS. 5A and 6A). The reflective surface 141 is close to the CCFL 21 without contacting with the CCFL 21. The reflective surface 141 has the technical character of reflecting the light rays. The reflector 14 is integrally formed by way of press forming, extruding or injection molding, and the assembled pictorial views are shown in FIGS. 5B and 6B. The external lamp 24 is made of at least one of a light-permeable material and a translucent material. The external lamp 24 is integrally formed by way of extruding. A sealant is added to the sealing portion between the external lamp 24 and the lamp head 32 to prevent the moisture from entering and increase the structural strength of the connection.

Figure 4:
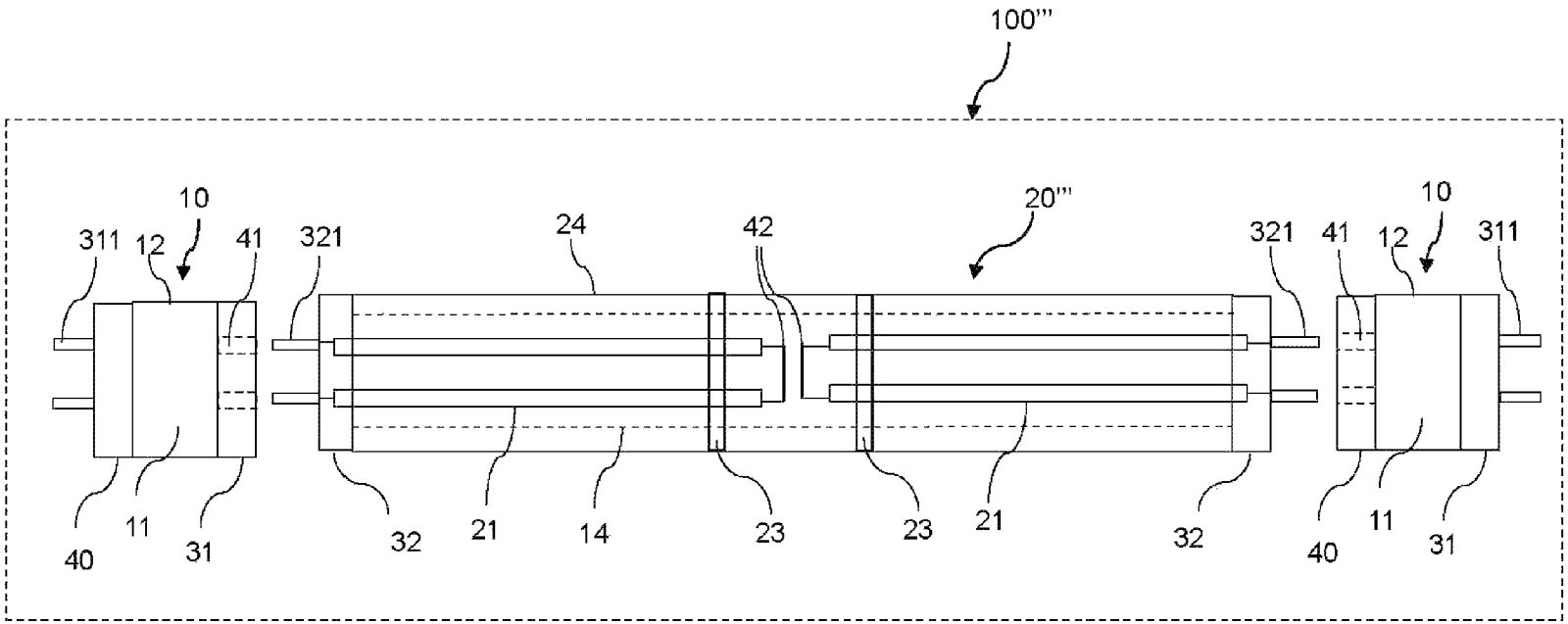
FIG. 4 is a schematic illustration showing a lamp cartridge adapter and a lamp module thereof according to yet still another embodiment of the invention.

FIG. 4 is a schematic illustration showing a lamp cartridge adapter and a lamp module 20'" thereof according to yet still another embodiment of the invention. As shown in FIG. 4, the U-shaped CCFL 21 of FIG. 3 is replaced with two straight CCFLs 21 connected together using a conductor 42 on one side. Because two U-shaped CCFLs 21 are used in FIG. 3, two sets of two straight CCFLs 21 have to be used and connected together using the conductor 42 on one side to replace the two U-shaped CCFLs 21. The CCFL 21 may also have any other shape.

After the lamp module 20 of the invention is combined with two lamp cartridge adapters 10, the length thereof is the same as the length of the conventional daylight lamp of T9, T8, T5 or the like.

FIG. 5A is a schematic illustration showing a lamp module according to an embodiment of the invention. Referring to FIG. 5A, the lamp module 20"" is composed of one external lamp 24, one reflector 14' and at least one CCFL 21. In order to solve the problem that the CCFL 21 tends to be broken when the lamp module 20"" is being transported, the lamp module 20"" further includes at least one support frame 23' having at least one support frame hole 231. The shape of the surface of the support frame 23' matches with the shape of the reflective surface 141' of the reflector 14' adjacent to the surface of the support frame 23'. The number of the support frame hole(s) 231 and the size of the aperture of the support frame hole 231 are determined according to the CCFL(s) 21. The size of the aperture of the support frame hole 231 is such that the CCFL 21 can just pass therethrough. The support frame 23' may also solve the problem of the parallelism of two of CCFLs 21. The external lamp 24 is made of at least one of light-permeable material and translucent material, and is integrally formed by way of extruding. The reflector 14' has one reflective surface 141'. The reflective surface 141' is close to the CCFL 21 without contacting with the CCFL 21. The reflective surface 141' has the function of reflecting light rays. The reflector 14' is integrally formed by way of press forming, extruding or injection molding, and the assembled pictorial view thereof is shown in FIG. 5B.

FIG. 6A is a schematic illustration showing a lamp module according to another embodiment of the invention. The maximum difference between FIG. 5A resides in that the reflective surface 141" of the reflector 14" has the substantial m-shape and can reflect the light rays of the CCFL 21 uniformly. The reflective surface 141" is close to the CCFL 21 without contacting with the CCFL 21. The reflective surface 141" has the technical character of reflecting the light rays. The support frame 23" has the substantially heart-like shape to match with the contact surface of the reflector 14". The external lamp 24" is integrally formed by way of extruding. The reflector 14" is integrally formed by way of press forming, extruding or injection molding, and the assembled pictorial view thereof is shown in FIG. 6B.

Figure 7:
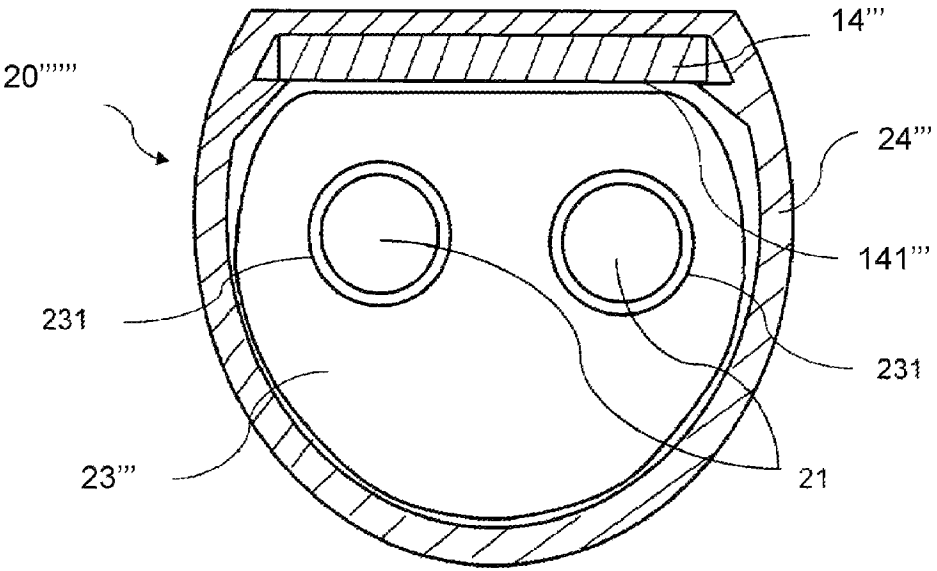
FIG. 7 is a schematic illustration showing an external lamp according to another embodiment of the invention.
Figure 8:
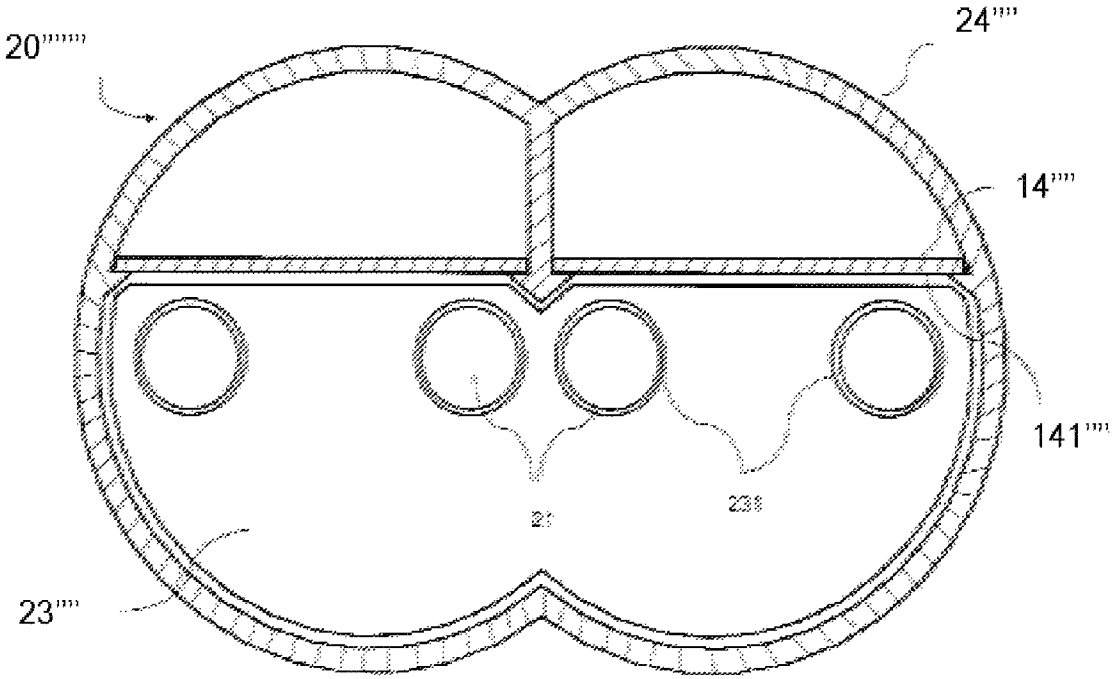
FIG. 8 is a schematic illustration showing an external lamp according to another embodiment of the invention.

FIG. 7 is a schematic illustration showing an external lamp according to another embodiment of the invention. The shape of external lamp 24''' of the lamp module 20''''' is any geometric tubular body. FIG. 8 is a schematic illustration showing an external lamp according to another embodiment of the invention. The shape of external lamp 24'''' of the lamp module 20'''''' is nearly liked a heart shape, and the connected technology is used by above mention embodies via combining a plurality cold cathode fluorescent lamp (CCFL).

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. An illumination device comprising:

a lamp module comprising:

an external elongated housing made of at least one of a transparent and a translucent material;

two lamp terminals located at opposite ends of the elongated housing, each lamp terminal having a plurality of lamp pins;

at least one cold cathode fluorescent lamp (CCFL) disposed in the external elongated housing; and a lamp cartridge adapter comprising:

an electronic adapter housing having two terminals, one terminal including an AC power input terminal, and another terminal including a pair of jacks electrically connected to the lamp pins, the two terminals located at opposite ends of the electronic adapter housing;

a pair of contact pins having first ends connected to the AC power input terminals of the electronic adapter housing, and second ends projecting from the electronic adapter housing; and wherein a combined length of the lamp module and the lamp cartridge adapter is the same as a standard fluorescent lamp tube.

2. The illumination device according to claim 1, wherein the lamp cartridge adapter is at least two lamp cartridge adapters respectively disposed on two ends of the lamp module, and a combined length the lamp cartridge adapters and the lamp module is the same as a standard fluorescent lamp tube.

3. The lamp module according to claim 1, wherein the external elongated housing is a tubular body.

4. The illumination device according to claim 1, wherein the support frame comprises at least one support frame hole, wherein the number and shape of the support frame holes are selected to receive the at least one CCFL.

5. The illumination device according to claim 1, wherein the support frame having at least one support frame hole, wherein the number and shape of the support frame holes are selected to receive the at least one CCFL.

6. The illumination device according to claim 1, wherein the cold cathode fluorescent lamp is a plurality of cold cathode fluorescent lamps, the lamp cartridge adapter is at least two lamp cartridge adapters respectively disposed on two ends of the lamp module, and a combined length of the lamp cartridge adapter and the lamp module is the same as a standard fluorescent lamp tube.

7. The illumination device according to claim 1, wherein the CCFL is a U-shaped lamp.

8. The illumination device according to claim 7, wherein the U-shaped lamp is formed by two straight CCFLs connected together in series using one conductor on one side.

* * * * *